US009739109B2

(12) United States Patent
Kroesen

(10) Patent No.: US 9,739,109 B2
(45) Date of Patent: Aug. 22, 2017

(54) BLOWOUT PREVENTER WITH PROJECTILE

(71) Applicant: Cameron International Corporation, Houston, TX (US)

(72) Inventor: Gerrit M. Kroesen, Friendswood, TX (US)

(73) Assignee: Cameron International Corporation, Houston, TX (US)

( * ) Notice: Subject to any disclaimer, the term of this patent is extended or adjusted under 35 U.S.C. 154(b) by 84 days.

(21) Appl. No.: 14/701,282

(22) Filed: Apr. 30, 2015

(65) Prior Publication Data

US 2016/0319624 A1 Nov. 3, 2016

(51) Int. Cl.
*E21B 29/08* (2006.01)
*E21B 33/06* (2006.01)

(52) U.S. Cl.
CPC ..... *E21B 33/063* (2013.01); *E21B 29/08* (2013.01)

(58) Field of Classification Search
CPC ..... E21B 33/063; E21B 33/06; E21B 33/068; E21B 33/02; E21B 33/10; E21B 17/01; E21B 33/061; E21B 33/062
USPC .... 166/55, 55.1, 55.2, 55.3, 297; 175/2, 3.5, 175/4.57
See application file for complete search history.

(56) References Cited

U.S. PATENT DOCUMENTS

| | | | | |
|---|---|---|---|---|
| 2,327,362 | A * | 8/1943 | McDonald | E21B 43/112 166/239 |
| 5,280,823 | A * | 1/1994 | Chabot | E21B 33/062 166/55 |
| 2007/0187109 | A1 | 8/2007 | Millheim et al. | |
| 2011/0030805 | A1 | 2/2011 | Foote | |
| 2012/0217018 | A1* | 8/2012 | Zediker | E21B 33/063 166/361 |
| 2013/0126153 | A1 | 5/2013 | Baker | |
| 2013/0153212 | A1 | 6/2013 | Myers | |
| 2013/0264503 | A1 | 10/2013 | Jahnke | |
| 2014/0000902 | A1* | 1/2014 | Wolfe | E21B 33/063 166/361 |
| 2015/0152704 | A1* | 6/2015 | Tunget | E21B 33/128 166/254.2 |

OTHER PUBLICATIONS

International Search Report and Written Opinion issued in corresponding PCT application No. PCT/US2016/028550 dated Jul. 29, 2016, 15 pgs.

* cited by examiner

*Primary Examiner* — David Bagnell
*Assistant Examiner* — Jonathan Malikasim
(74) *Attorney, Agent, or Firm* — Chamberlain Hrdlicka

(57) ABSTRACT

An apparatus includes a blowout preventer housing comprising a bore extending therethrough and a cavity intersecting the bore and a shear ram movably positionable within the cavity and at least partially movable into the bore of the blowout preventer housing. The apparatus further includes a projectile receivable into the bore of the blowout preventer housing and configured to pierce a tubular member when positioned within the bore of the blowout preventer housing.

20 Claims, 4 Drawing Sheets

BLOWOUT PREVENTER WITH PROJECTILE

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Blowout preventers (BOPs) are used extensively throughout the oil and gas industry. Typical blowout preventers are used as a large specialized valve or similar mechanical device that seal, control, and monitor oil and gas wells. The two categories of blowout preventers that are most prevalent are ram blowout preventers and annular blowout preventers. Blowout preventer stacks frequently utilize both types, typically with at least one annular blowout preventer stacked above several ram blowout preventers. The ram units in ram blowout preventers allow for both the shearing of the drill pipe and the sealing of the blowout preventer. A blowout preventer stack may be secured to a wellhead and may provide a safe means for sealing the well in the event of a system failure.

In a typical ram blowout preventer, a ram bonnet assembly may be bolted to the main body using a number of high tensile bolts or studs. These bolts are required to hold the bonnet in position to enable the sealing arrangements to work effectively. During normal operation, the blowout preventers may be subject to pressures up to 20,000 psi, or even higher. To be able to operate against and to contain fluids at such pressures, blowout preventers are becoming larger and stronger. Blowout preventer stacks, including related devices, 30 feet or more in height are increasingly common. These blowout preventers, even with all this supporting equipment, may still have difficulties cutting and shearing some tubular members though commonly used within the industry.

BRIEF DESCRIPTION OF THE DRAWINGS

For a detailed description of embodiments of the subject disclosure, reference will now be made to the accompanying drawings in which.

DETAILED DESCRIPTION

Figure 1:
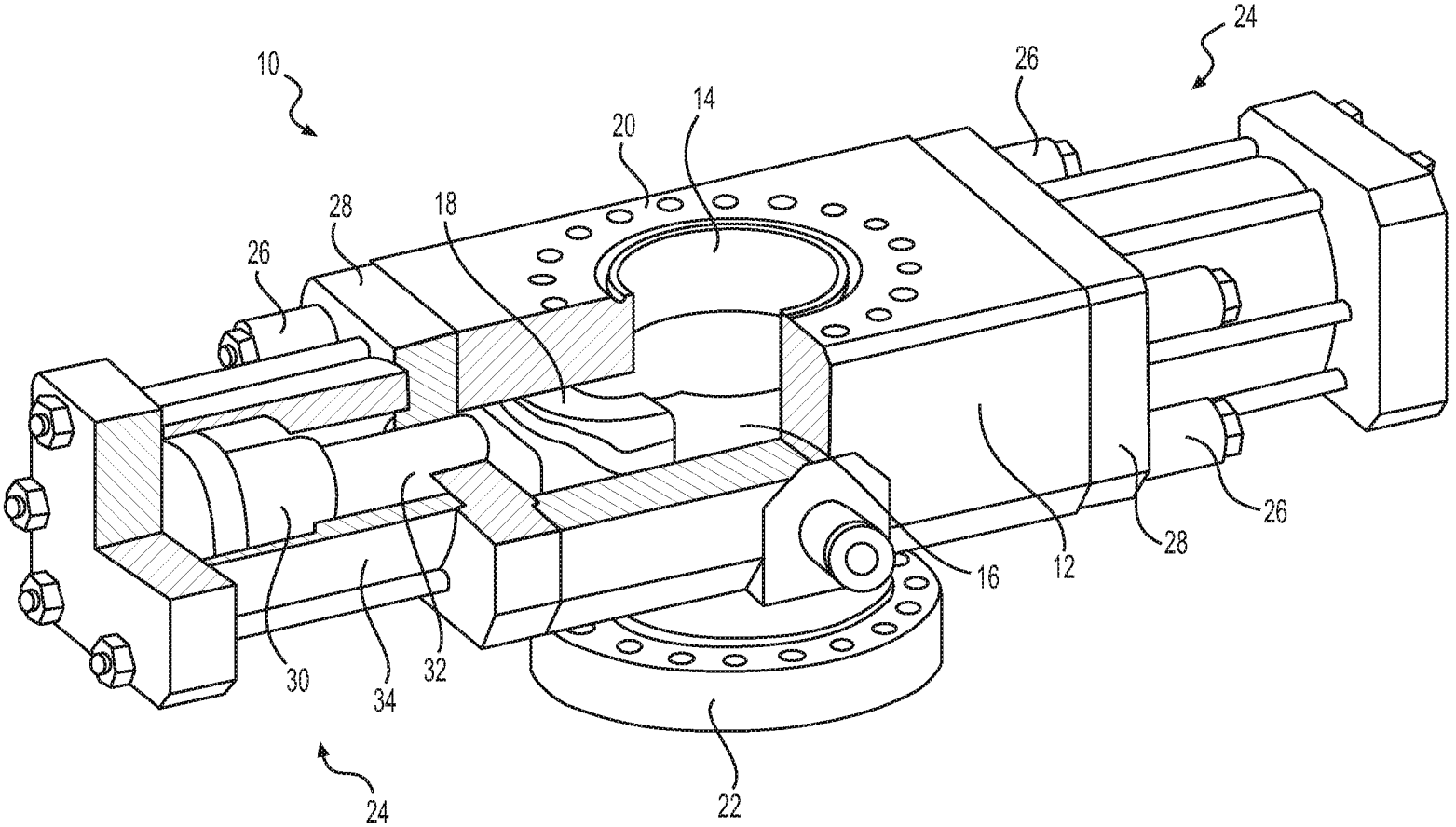
FIG. 1 shows a sectional view of a blowout preventer.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. The embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be an illustration of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Referring now to FIG. 1, a sectional view of a blowout preventer 10 is shown. The blowout preventer 10 includes a housing 12, such as a hollow body, with a bore 14 that enables passage of fluid or a tubular member through the blowout preventer 10. The housing 12 further includes one or more cavities 16, such as cavities 16 opposed from each other with respect to the bore 14, with a ram 18 movably positioned within each cavity 16. The blowout preventer 10 may be coupled to other equipment that facilitates natural resource production. For instance, production equipment or other components may be attached to the top of the blowout preventer 10 using a connection 20 (which may be facilitated in the form of fasteners), and the blowout preventer 10 may be attached to a wellhead or spool using the flange 22 and additional fasteners.

One or more bonnet assemblies 24 are secured to the housing 12 and include various components that facilitate control of the rams 18 positioned in the blowout preventer 10. The bonnet assemblies 24 are coupled to the housing 12 by using one or more fasteners 26 to secure the bonnets 28 of the bonnet assemblies 24 to the housing 12. The rams 18 are then actuated and moved through the cavities 16, into and out of the bore 14, by operating and moving a piston 30 and a rod 32 coupled thereto within a housing 34 of the bonnet assemblies 24. In operation, a force (e.g., from hydraulic pressure) may be applied to the pistons 30 to drive the rods 32, which in turn drives the rams 18 coupled thereto into the bore 14 of the blowout preventer 10. The rams 18 cooperate with one another when driven together to seal the bore 14 and inhibit flow through the blowout preventer 10.

In another embodiment, the rams 18 may be shear rams such that, when driven towards each other, shear a tubular member present within the bore 14 of the housing 12 of the blowout preventer 10.

Figure 2A:
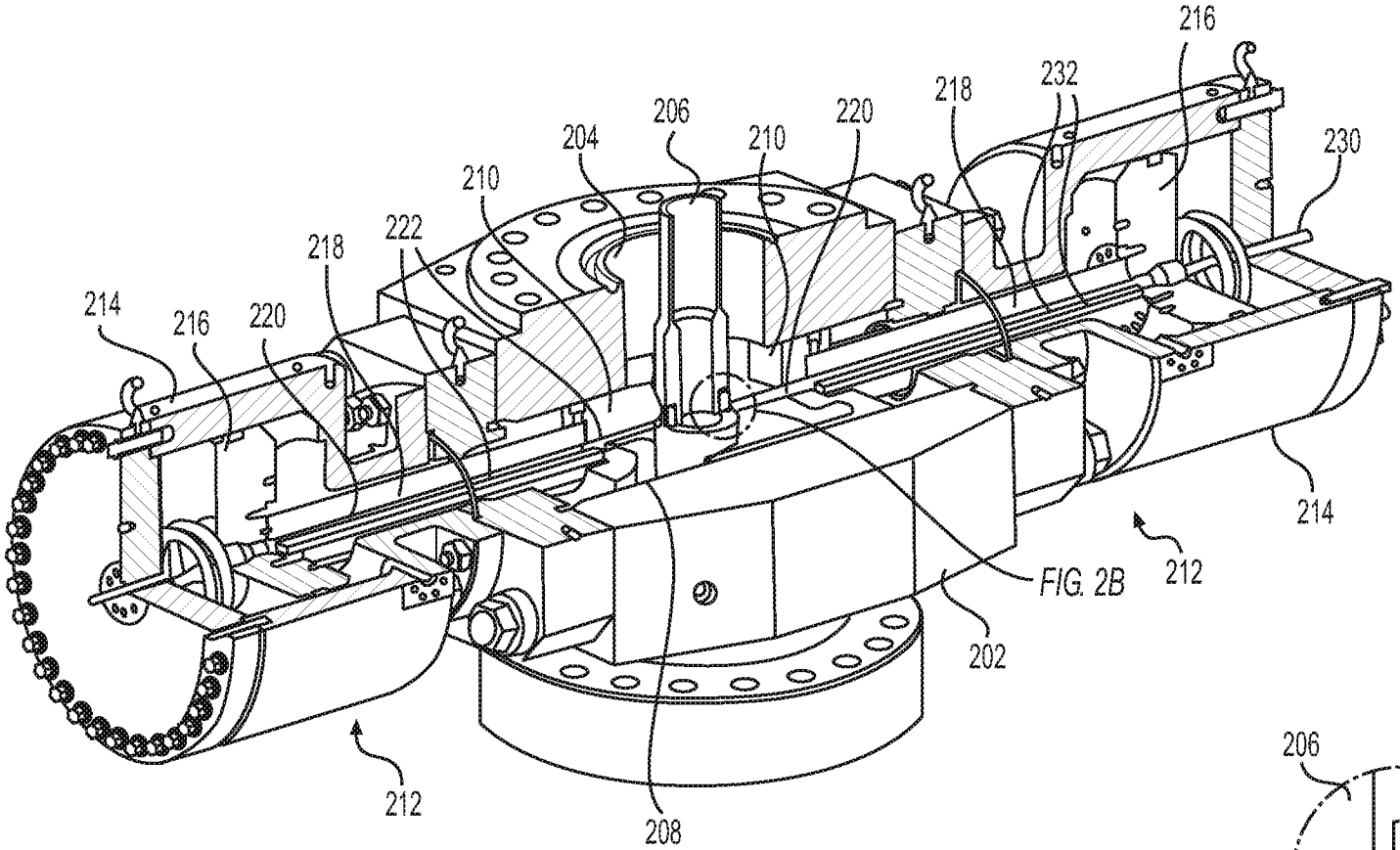
FIG. 2A shows a perspective sectional view of blowout preventer in accordance with one or more embodiments of the present disclosure.
Figure 2B:
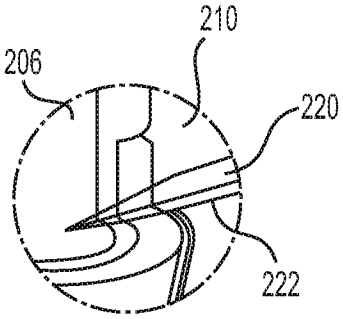
FIG. 2B shows a detail view from FIG. 2A of a projectile piercing a tubular member within the blowout preventer in accordance with one or more embodiments of the present disclosure.
Figure 3:
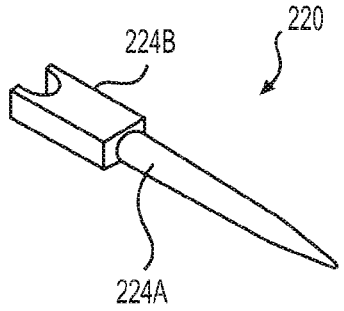
FIG. 3 shows a perspective view of a projectile in accordance with one or more embodiments of the present disclosure.
Figure 4:
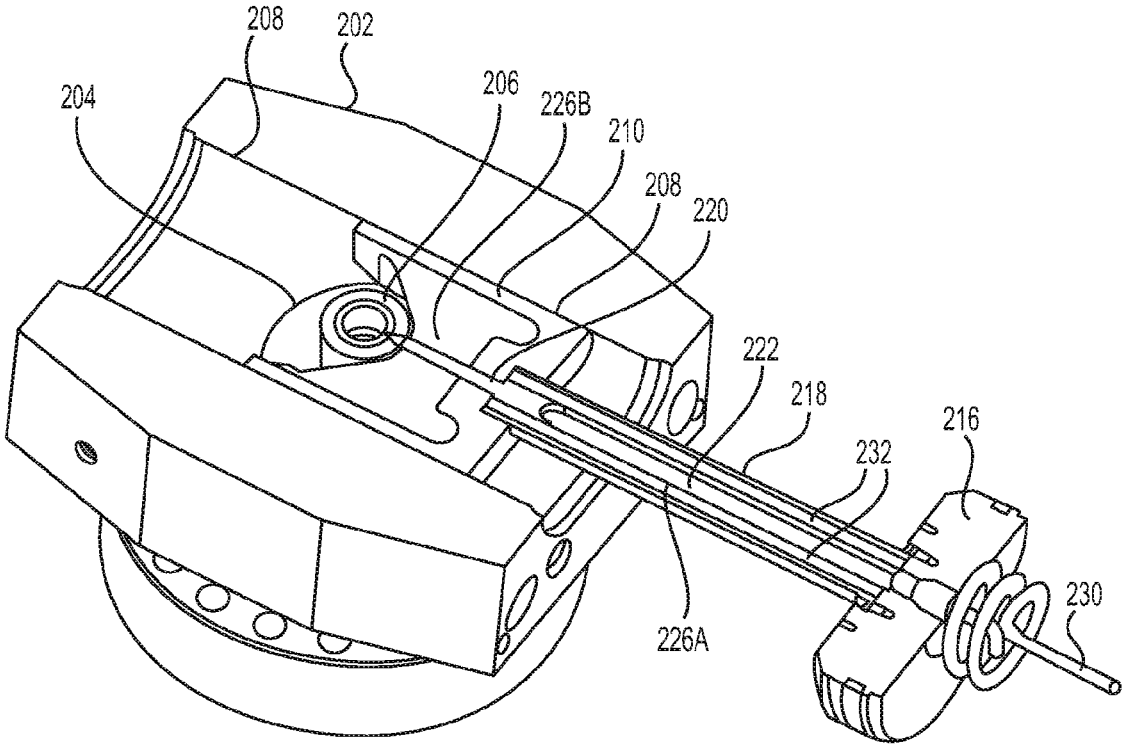
FIG. 4 shows a perspective cross-sectional view of a blowout preventer in accordance with one or more embodiments of the present disclosure.
Figure 5:
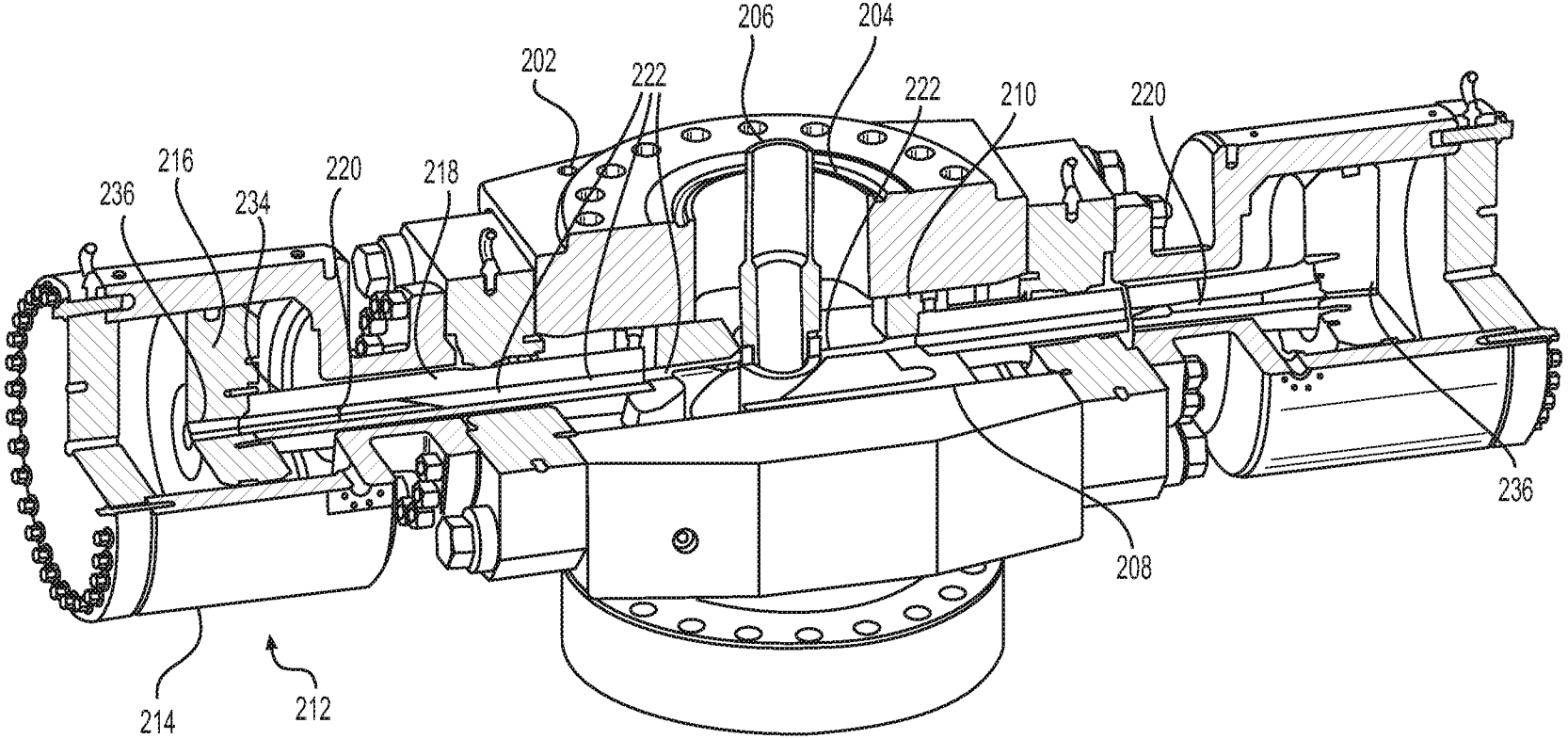
FIG. 5 shows a perspective sectional view of a blowout preventer in accordance with one or more embodiments of the present disclosure.

Referring now to FIGS. 2A, 2B, 3, 4, and 5, multiple views of a blowout preventer 200 including one or more projectiles 220 in accordance with one or more embodiments of the present disclosure are shown. The projectiles 220 may be included within the blowout preventer 200 to facilitate shearing a tubular member 206 that is present within a bore 204 of the blowout preventer 200. FIG. 2A shows a perspective sectional view of the blowout preventer 200, FIG. 2B shows a detail view from FIG. 2A of the projectile 220 piercing the tubular member 206 within the blowout preventer 200, FIG. 3 shows a perspective view of the projectile 220, FIG. 4 shows a perspective cross-sectional view of the blowout preventer 200, and FIG. 5 shows a perspective sectional view of another blowout preventer 200.

The blowout preventer 200 includes a housing 202 with a bore 204 extending through the housing 202. The tubular member 206 as shown, which may include a tool joint, a drill collar, and/or a drilling tubular, may be received and positioned within the bore 204 of the housing 202. The blowout preventer housing 202 further includes cavities 208 that intersect the bore 204, with the cavities 208 formed and positioned opposite each other with respect to the bore 204. Rams 210 are then movably positioned within the housing 202 of the blowout preventer 200. In particular, a ram 210, such as a shear ram in this embodiment, is movably positioned within each cavity 208 to extend into and retract from the bore 204 of the housing. As such, the rams 210 may be used to engage and shear the tubular member 206 positioned within the bore 204 of the housing 202.

Bonnet assemblies 212 may be included with the blowout preventer 200, in which each bonnet assembly 212 corresponds with a ram 210. A bonnet assembly 212 is used to move the ram 210 within the cavity 208 and the housing 202 of the blowout preventer 200. The bonnet assembly 212 includes a bonnet assembly housing 214 secured or coupled to the blowout preventer housing 202. A piston 216 is movably positioned within the bonnet assembly housing 214, and a rod 218 is coupled between the piston 216 and the ram 210 to enable the piston 216 to move the ram 210 within the cavity 208 and the housing 202 of the blowout preventer 200. For example, hydraulic pressure may be selectively applied to the piston 216 to drive the rod 218, which in turn drives and moves the ram 210 within the cavity 208 and the housing 202 of the blowout preventer 200.

As discussed above, one or more projectiles 220 may be included within the blowout preventer 200 to facilitate shearing the tubular member 206 positioned within the bore 204 of the blowout preventer 200, The projectile 220 may be receivable into and extend into the bore 204 of the blowout preventer housing 202. For example, in this embodiment, the projectile 220 may be receivable through the ram 210 to extend past the ram 210 and into the bore 204 of the blowout preventer housing 202. This motion may enable the projectile 220 to pierce and/or sever the tubular member 206, which in turn may facilitate the shearing of the tubular member 206 with the ram 210.

As shown, particularly in FIG. 2A, a projectile 220 may be included to correspond with each ram 210. For example, as two rams 210 are positioned within the blowout preventer housing 202 and opposite each other with respect to the bore 204, a projectile 220 may be included to be received through and extend past each ram 210 into the bore 204. However, the present disclosure is not so limited, as other embodiments are contemplated and are included within the scope of the present disclosure. For example, only one projectile may be included within an embodiment, though more than one ram may be included within a blowout preventer. Additionally or alternatively, the projectile may not need to correspond with a ram at all, as the projectile may be projected into the bore of the blowout preventer along a path that does not correspond to the ram. For example, a projectile may be projected and received into the bore of the blowout preventer along a path that is perpendicular to the motion of the rams. Accordingly, other configurations that include a projectile within a blowout preventer are contemplated within the scope of the present disclosure.

Referring still to FIGS. 2A, 2B, 3 and 4, in this embodiment, the projectile 220 may be receivable into the bore 204 of the blowout preventer housing 202 through the rod 218 and/or the ram 210. For example, as shown, a channel 222 may be formed into or through the rod 218, and through the ram 210, and extend towards the bore 204. The projectile 220 is movable within the channel 222 to enable the projectile 220 to be received within the bore 204 of the housing 202. The channel 222 may enable the projectile 220 to then extend past the ram 210, at least partially, such that the projectile 220 may pierce the tubular member 206.

In one or more embodiments, a barrier may be included, such as within the channel 222, to prevent contents within the bore 204 of the blowout preventer 200 from entering into the channel 222. For example, a frangible material, a wax or clay material, a welded material, or any other suitable type of material capable of withstanding the contents within the bore 204 of the blowout preventer 200 may be included within the channel 222 to prevent the contents from entering the channel 222. The barrier may particularly be formed at an opening of the channel within the ram 210. The projectile 220 may then pierce the barrier when activated to move towards the bore 204 of the blowout preventer housing 202, as the projectile 220 may be formed of a material harder than that of the barrier. As such, in one or more embodiments, the projectile 220 may be formed or include tungsten carbide, or another suitably strong material. In such an embodiment, the barrier may be formed of a material that does not have the strength of tungsten carbide.

One or more different power sources may be used to move the projectile 220 within the blowout preventer 200. As shown in FIGS. 2A and 4, a hydraulic power source 230 may be used to create pressure and move or project the projectile 220. In this embodiment, the hydraulic power source 230 may be in communication with the channel 222, and then create or inject hydraulic fluid into the channel 222 to move and project the projectile 220 towards the bore 204 of the blowout preventer housing 202. Similarly, a pneumatic power source may be used to create pressure and move or project the projectile 220.

In another embodiment, an electromagnetic power source may be used to move or project the projectile 220 within the blowout preventer 200. For example, as shown in FIGS. 2A and 4, one or more electromagnetic rails 232 may be included along the channel 222. This may enable the electromagnetic rails 232 to use electromagnetic effects to propel and accelerate the projectile 220 along the channel 222 and towards the bore 204 of the blowout preventer housing 202.

Additionally or alternatively, as shown in FIG. 5, an explosive charge 234 may be used to move or project the projectile 220 within the blowout preventer 200. The explosive charge 234 may be positioned at an end of the channel 222 to project the projectile 220 along the channel 222 and towards the bore 204 of the blowout preventer housing 202. The activation of the explosive charge 234 may then be controlled by a firing pin 236. In this embodiment, the firing pin 236 may be positioned within the piston 216 and selectively activated or fired to explode the explosive charge 234, which in turn projects and moves the projectile 220 into the bore 204 of the blowout preventer housing 202.

In one or more embodiments, a projectile stop may be included to prevent the projectile 220 from completely exiting the ram 210 and escaping into the bore 204 of the blowout preventer 200 or falling downhole from the blowout preventer 200. For example, as best shown in FIGS. 3 and 4, the projectile 220 may have multiple profiles, and the channel 222 have multiple profiles, to prevent any further movement of the projectile 220 along the channel 222 and towards the bore 204. In this embodiment, the projectile 220 includes a first profile 224A and a second profile 224B with the first profile 224A different (e.g., smaller in this embodiment) than the second profile 224B. The channel 222 also includes a first profile 226A and a second profile 226B with the first profile 224A different (e.g., larger in this embodiment) than the second profile 224B. The first profile 226A of the channel 222 enables the both profiles 224A and 224B of the projectile 220 to pass therethrough such that the projectile 220 may travel and move without any significant restraints. However, the second profile 226B of the channel 222 may only enable the first profile 224A of the projectile 220 to pass therethrough, thereby stopping and preventing any further movement of the projectile 220 along the channel 222. This engagement between the projectile 220 and the channel 222 may prevent the projectile 220 from completely exiting the ram 210 and escaping into the bore 204 of the blowout preventer 200 or falling downhole from the blowout preventer 200.

As mentioned above, a blowout preventer in accordance with the present disclosure may be used to shear tubular members having higher strengths and sizes, such as due to the use of a projectile. For example, a tool joint or a drill collar may have higher strengths than other tubular members, and a blowout preventer in accordance with the present disclosure may be used to facilitate shearing the tool joint, The projectile may be used to pierce or sever the tool joint, such as to at least create a stress concentration, and the shear rams of the blowout preventer may then be used to shear the remainder of the weakened tooljoint. As such, in one embodiment when in use, the projectile may be fired or moved either before or as the shear rams are activated and moved, thereby enabling the shear rams to shear the tubular member after being pierced by the projectile. In another embodiment, the projectile may be fired only after an unsuccessful shearing attempt by the shear rams. For example, if the shear rams cannot successfully shear a tubular member, the projectile may then be fired to facilitate the shearing with the shear rams of the blowout preventer.

Although the present invention has been described with respect to specific details, it is not intended that such details should be regarded as limitations on the scope of the invention, except to the extent that they are included in the accompanying claims.

What is claimed is:

1. An apparatus, comprising:

a blowout preventer housing comprising a bore extending therethrough and a cavity intersecting the bore;

a shear ram movably positionable within the cavity and at least partially movable into the bore of the blowout preventer housing; and a projectile receivable into the bore of the blowout preventer housing and configured to pierce a tubular member when positioned within the bore of the blowout preventer housing.

2. The apparatus of claim 1, further comprising:

a bonnet housing;

a rod configured to move the shear ram;

a piston movably positionable within the bonnet housing and configured to move the rod; and wherein the projectile is receivable into the bore of the blowout preventer housing through the rod.

3. The apparatus of claim 2, wherein the rod and the ram comprise a channel formed therethrough such that the projectile is movable within the channel to be received into the bore of the blowout preventer housing.

4. The apparatus of claim 3, further comprising a barrier positioned within the channel to prevent contents from the bore of the blowout preventer housing from entering the channel.

5. The apparatus of claim 1, wherein the projectile is receivable through and extendable past the shear ram when received into the bore of the blowout preventer housing.

6. The apparatus of claim 5, further comprising a projectile stop to prevent the projectile from completely exiting the shear ram when received into the bore of the blowout preventer.

7. The apparatus of claim 6, wherein the projectile stop comprises a first profile of the projectile that is different from a second profile of the projectile.

8. The apparatus of claim 1, wherein the projectile comprises tungsten carbide.

9. The apparatus of claim 1, further comprising a second projectile positioned opposite the first projectile with respect to the bore of the blowout preventer housing, the second projectile receivable into the bore of the blowout preventer housing.

10. The apparatus of claim 1, further comprising at least one of a hydraulic power source, a pneumatic power source, and an electromagnetic power source to project the projectile into the bore of the blowout preventer housing.

11. The apparatus of claim 1, further comprising an explosive charge to project the projectile into the bore of the blowout preventer housing.

12. The apparatus of claim 1, wherein the tubular member comprises a tool joint and the projectile is configured to pierce the tool joint when received into the bore of the blowout preventer housing.

13. An apparatus, comprising:

a blowout preventer housing comprising a bore extending through the blowout preventer housing;

a shear ram positionable within the blowout preventer housing and at least partially movable into the bore of the blowout preventer housing; and a projectile receivable through the shear ram to extend past the shear ram and into the bore of the blowout preventer housing and configured to pierce a tubular member when positioned within the bore of the blowout preventer housing.

14. The apparatus of claim 13, further comprising:

a second shear ram positionable within the blowout preventer housing opposite the first shear ram with respect to the bore of the blowout preventer housing, the second shear ram at least partially movable into the bore of the blowout preventer housing; and a second projectile receivable through the second shear ram to extend past the second shear ram and into the bore of the blowout preventer housing and configured to pierce the tubular member when positioned within the bore of the blowout preventer housing.

15. The apparatus of claim 13, further comprising:

a bonnet housing coupleable to the blowout prevent housing;

a rod configured to move the shear ram;

a piston movably positionable within the bonnet housing and configured to move the rod; and wherein the projectile is receivable into the bore of the blowout preventer housing through the rod.

16. The apparatus of claim 15, wherein the rod and the ram comprise a channel formed therethrough such that the projectile is movable within the channel to be received into the bore of the blowout preventer housing.

17. The apparatus of claim 16, further comprising a barrier positioned within the channel to prevent contents from the bore of the blowout preventer housing from entering the channel.

18. The apparatus of claim 13, further comprising a projectile stop to prevent the projectile from completely exiting the shear ram when received into the bore of the blowout preventer.

19. The apparatus of claim 13, wherein the projectile comprises tungsten carbide.

20. The apparatus of claim 13, wherein the tubular member comprises a tool joint and the projectile is configured to pierce the tool joint when received into the bore of the blowout preventer housing.

* * * * *